United States Patent [19]

Williams et al.

[11] Patent Number: 4,852,759

[45] Date of Patent: Aug. 1, 1989

[54] PAINT TRIM TRAY APPARATUS

[76] Inventors: Walter J. Williams; David L. Fost, both c/o P.S. Paint Shop Ltd., P.O. Box 13575, St. John's, Newfoundland A1B 4B8, Canada

[21] Appl. No.: 162,882

[22] Filed: Mar. 2, 1988

[51] Int. Cl.[4] ..... B65D 83/00

[52] U.S. Cl. ..... 220/85 H; 220/85 SP; D32/53.1

[58] Field of Search ..... 220/85 H, 85 SP; D32/53, 53.1, 54; 119/52 R, 72, 74; D7/37, 359, 363

[56] References Cited

U.S. PATENT DOCUMENTS

| | | | |
|---|---|---|---|
| D. 164,273 | 8/1951 | Auth | D32/53.1 |
| D. 187,237 | 2/1960 | Kindelberger | D7/359 |
| D. 264,897 | 6/1982 | Smith | D32/53.1 |
| 996,214 | 6/1911 | Cockrum | 119/52 R |
| 1,874,141 | 8/1932 | Sueper | 119/72 |
| 2,138,544 | 11/1938 | Gulla | 119/74 |
| 2,584,383 | 2/1952 | Feck | 119/74 |
| 3,136,296 | 6/1964 | Luin | 119/52 R |
| 3,730,141 | 5/1973 | Manning et al. | 119/52 R |
| 4,034,715 | 7/1977 | Arner | 119/52 R |
| 4,203,537 | 5/1980 | McAlister | D32/54 |

OTHER PUBLICATIONS

"Country Gentleman", Jun. 19, 1915, p. 1059, A Nail--Keg Hopper.

"Popular Mechanics", Dec. 1946, p. 193, Handy Self-Feeder for Rabbits.

*Primary Examiner*—Harvey C. Hornsby
*Assistant Examiner*—Christine A. Peterson
*Attorney, Agent, or Firm*—Leon Gilden

[57] ABSTRACT

A paint trim tray apparatus is set forth wherein a planar bottomed pan has formed thereto angulated walls wherein at a first junction of the walls, a pour spout is formed. Spaced from said pour spout is a paint can securement ring formed with an opening including a medially indented circumferential grasping ring resiliently for engaging a can exterior and forming a channel in cooperation with said can to direct overflow paint within the so-formed channel through the opening in alignment with the aforenoted pour spout.

1 Claim, 3 Drawing Sheets

PAINT TRIM TRAY APPARATUS

BACKGROUND OF THE INVENTION

1. Field of the Invention

The field of the invention relates to paint can securement apparatus, and more particularly pertains to a new and improved paint can trim apparatus wherein a paint can is frictionally engaged by a broken securement ring forming a channel to direct paint flowing from said can through said channel to said opening and ultimately to a pour spout formed in said tray.

2. Description of the Prior Art

The use of paint can securement apparatus is well known in the prior art. As may be appreciated, these devices have normally been of configuration and structural relationship to accommodate overflow of paint within a container or within the tray itself, as is typically caused in the normal usage of paint when applied. Various structural organizations have been utilized to provide means for securement of paint but have been of limited utility in the securement of a relatively small paint can, such as the one quart can, as is typically utilized in the painting of trim as in a residential dwelling. An example of such prior art is presented in U.S. Pat. No. Des. 205,443 to Layman. A paint tray is set forth for securement at opposite ends to portions of a ladder where a forward portion utilizes a curvilinear lip to cooperate with a ladder rung wherein the opposed side utilizes a securement chain for attachment to position the paint tray with respect to a ladder. While a functional solution for the securement of paint within the container or tray, the patent fails to provide means for securement of a paint can with associated paint directing and pour spout means for disposition of paint that is spilled in usage.

U.S. Pat. No. Des. 223,864 to Vines illustrates a reversible tray formed with varying creases to provide a paint tray utilized with bulk paint and not with individual paint cans, as does the instant invention.

U.S. Pat. No. Des. 245,450 to Donion illustrates a paint container formed with a central paint containment portion integrally secured and formed to an underlying tray wherein a cross bar formed within the central containment portion potentially may be utilized for the removal of excess paint from a brush, but as in other prior art patent, the Donion patent is of an organization relatively remote from the instant invention.

U.S. Pat. No. Des. 264,897 to Smith sets forth a paint tray and removable liner which illustrates a mere further example of a paint tray apparatus for use with paint from a bulk paint supply, as opposed to the securement of individual quart-type cans of paint for use specifically for trim applications.

U.S. Pat. No. Des. 273,725 to Goetz illustrates yet another paint tray apparatus for use with paint from a bulk paint supply poured into the paint tray.

U.S. Pat. No. 1,959,262 to Colabrese illustrates a securable protector frictionally engageable with the bottom of a paint can to protect the pail from damage. The Colabrese patent, while an effective structure for use as a protector, is of an organization remote from the instant invention.

As such, it may be appreciated that there is a continuing need for a new and improved paint trim tray apparatus which addresses both the problem of portability and effectiveness, and in this respect, the present invention substantially fulfills this need.

SUMMARY OF THE INVENTION

In view of the foregoing disadvantages inherent in the known types of paint trim tray apparatus now present in the prior art, the present invention provides a paint trim tray apparatus wherein the same may be efficiently positioned about any planar support surface for frictional and resilient engagement of a paint can and direct overflow from said paint can to a pour spout aligned with an opening and a securement means on said paint tray apparatus. As such, the general purpose of the present invention, which will be described subsequently in greater detail, is to provide a new and improved paint trim tray apparatus which has all the advantages of the prior art paint tray apparatus and none of the disadvantages.

To attain this, the present invention comprises an elongate paint trim tray container formed with outwardly directed sloping walls joined at corners wherein one of the corners is formed with an outwardly directed pour spout. An interiorly positioned discontinuous paint can securement ring is integrally secured to a bottom portion of the paint trim tray apparatus formed with a vertical slit therein to form a discontinuous circle wherein said slit is aligned with said pour spout. The paint can securement ring is upwardly directed from a floor of the paint trim tray apparatus and formed with a circumferential interiorly directed bulge for resilient engagement of a paint can wherein a channel is formed between said paint can and an upward flange directed upwardly from said bulge to direct overflow paint about the paint can and to said slit and thereafter to said pour spout.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint trim tray apparatus which has all the advantages of the prior art paint trim tray apparatus and none of the disadvantages.

It is another object of the present invention to provide a new and improved paint trim tray apparatus which may be easily and efficiently manufactured and marketed.

It is a further object of the present invention to provide a new and improved paint trim tray apparatus which is of a durable and reliable construction.

An even further object of the present invention is to provide a new and improved paint trim tray apparatus which is susceptible of a low cost of manufacture with regard to both materials and labor, and which accordingly is then susceptible of low prices of sale to the consuming public, thereby making such paint trim tray apparatus economically available to the buying public.

Still yet another object of the present invention is to provide a new and improved paint trim tray apparatus which provides in the apparatuses and methods of the prior art some of the advantages thereof, while simultaneously overcoming some of the disadvantages normally associated therewith.

Still another object of the present invention is to provide a new and improved paint trim tray apparatus where a planar support floor is formed with outwardly directed walls formed at oblique angles greater than 90 degrees to said tray floor wherein the walls form a continuous perimeter forming a container wherein one corner of the joined walls is formed as an outwardly directed pour spout.

Yet another object of the present invention is to provide a new and improved paint trim tray apparatus wherein a discontinuous paint can securement ring is formed integrally to said tray floor.

Even still another object of the present invention is to provide a new and improved paint trim tray apparatus wherein a paint can securement ring is positioned proximate a pour spout in said trim tray apparatus and is formed with an inwardly directed bulge to resiliently grasp a paint can within said discontinuous ring and form a channel about an upper portion of said ring with an included paint can to form a directed conduit to a slit forming the discontinuity in said ring and aligned with said pour spout.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view taken along the lines 4—4 of FIG. 2 in the directions indicated by the arrows.

DESCRIPTION OF THE PREFERRED EMBODIMENT

Figure 1:
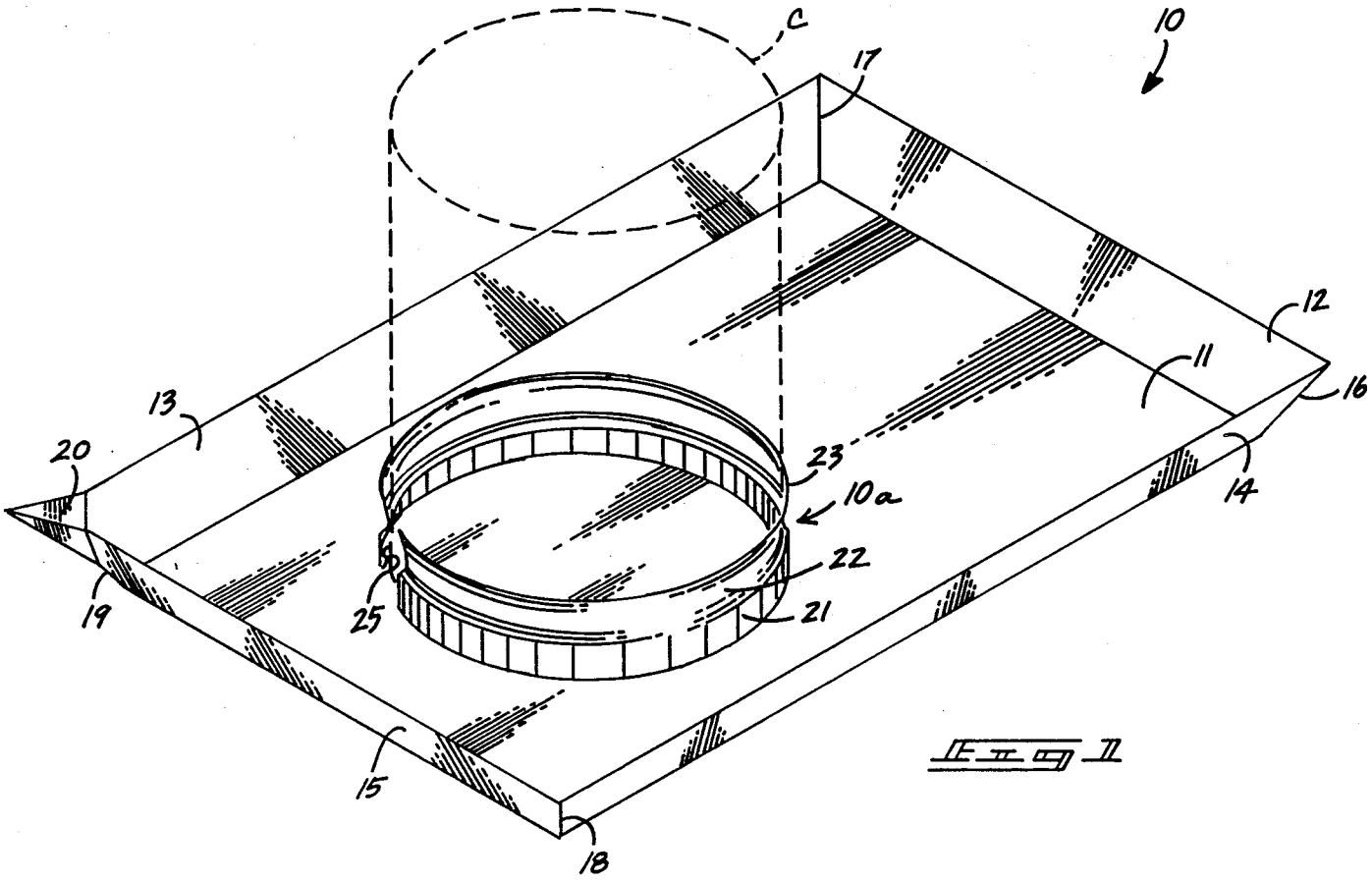
FIG. 1 is an isometric illustration of the instant invention.
Figure 2:
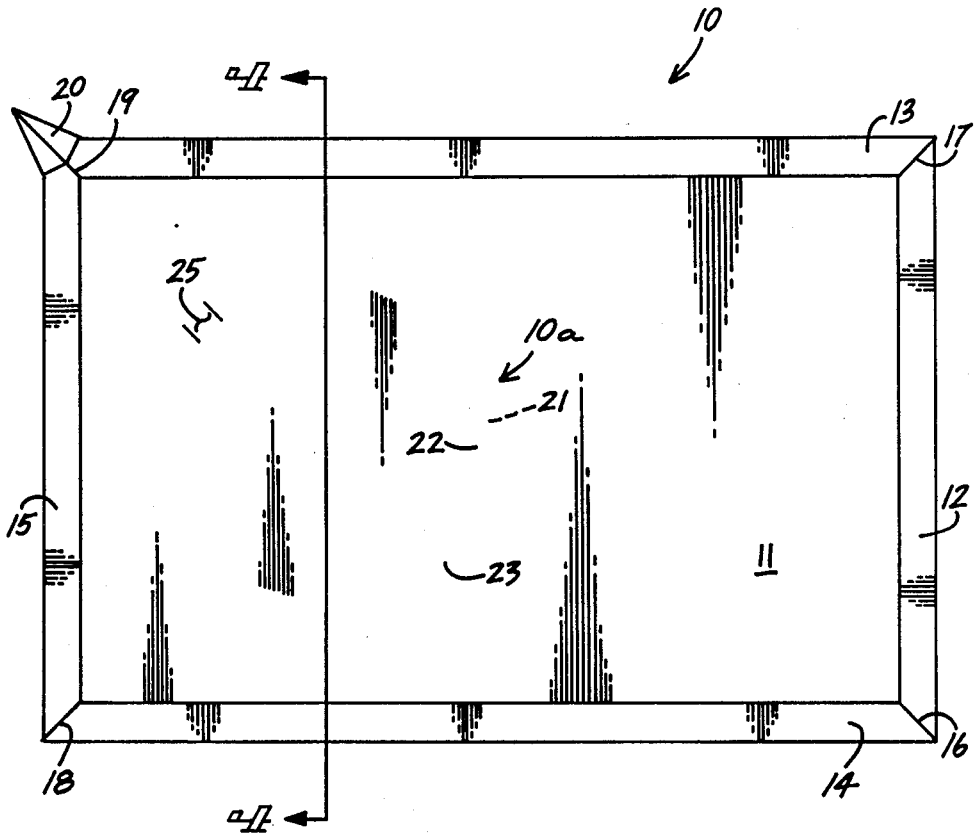
FIG. 2 is a top orthographic illustration of the instant invention.
Figure 3:
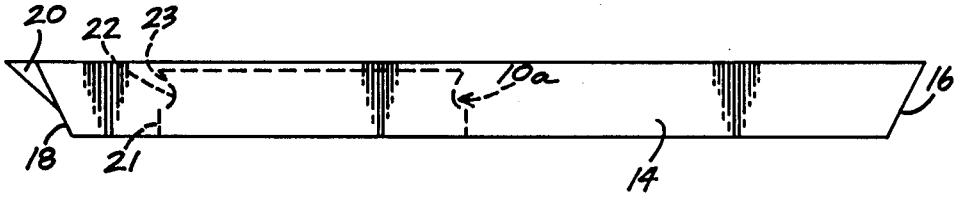
FIG. 3 is a side orthographic illustration of the instant invention.
Figure 3:
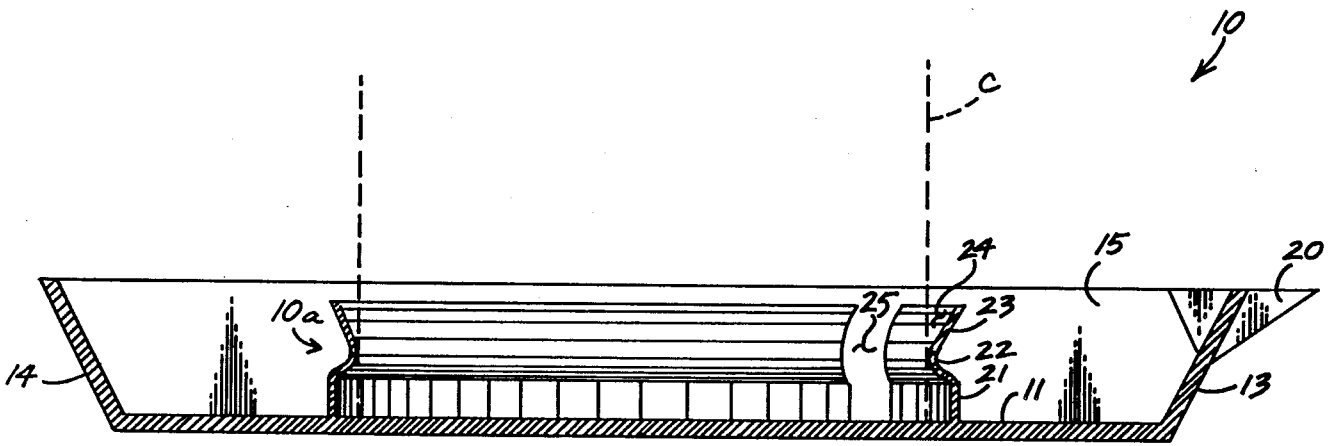

With reference now to the drawings, and in particular to FIGS. 1 to 4 thereof, a new and improved paint trim tray apparatus embodying the principles and concepts of the present invention and generally designated by the reference numeral 10 will be described.

More specifically, it will be noted that the paint trim tray apparatus 10 includes a paint can securement ring **10*a* positioned offset within the trim tray container portion of the apparatus to provide a greater useful surface area for accepting paint brushes and the like utilized in the trim painting procedure. As illustrated in FIG. 1, the apparatus 10 comprises a planar rectangular floor 11 formed with a rear wall 12, a first side wall 13, a second side wall 14, and a forward wall 15. The walls integrally secured to each other and the floor 11 are oriented at oblique angles to the floor 11 greater than 90 degrees. The walls 12, 13, 14, and 15, are joined at 45 degree angles at a first corner 16 joining rear and second side wall, second corner 17 joining rear and first side wall 13, third corner 18 joining second side wall 14 and forward wall 15, and fourth corner 19 joining forward wall 15 and first side wall 13. The fourth corner 19 is extensive along only approximately one-half the height of the respective walls 13 and 14 wherein a pour spout 20 is formed to said first side wall 13 and forward wall 15** outwardly directed with the top edges thereof generally coextensive with the top edge portions of the various walls.

The discontinuous paint can securement ring **10*a* is formed with an opening slit 25 aligned with the pour spout 20. The securement ring is formed with a lower, generally vertical, wall 21 merging into an inwardly directed medially bulged clamping portion 22 and merging upwardly thereto into an outwardly directed upper wall 23. With a paint can "C" inserted within the resiliently securable paint can securement ring 10*a*, a formed conduit 24 is formed between a vertical wall of paint can "C" and the upper wall 23 whereupon paint spilling from paint can "C" will be directed within conduit 24 and outwardly therefrom through opening slit 25 towards the pour spout 20 to enhance removal of overflow paint within the paint trim tray apparatus 10 and return said paint to can "C" via the pour spout 20, as paint will tend to first accumulate between opening 25 and spout 20 to limit loss of paint by its dispersion throughout floor 11**.

In use, a paint can "C" of generally a quart size configuration is utilized wherein the upper wall 23 tends to guide the paint can "C" towards the clamping portion 22 which thereupon resiliently engages the paint can "C" for use.

The paint trim tray apparatus 10 may be formed of any suitable plastic-like or metallic material providing the characteristics as set forth above.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint trim tray apparatus for the selective securement of a paint can containing fluid paint within, said apparatus comprising, a rectangular planar floor including a plurality of walls integrally secured to said floor upwardly directed from said floor to an equal predetermined height, and each of said walls joined to form a continuous perimeter, a pouring spout means for directing paint overflowing from said paint can formed at an intersection of two of said walls, securement means for resiliently engaging said paint can integrally formed and upward directed from said floor, wherein each of said walls being obliquely secured at an angle greater than 90 degrees to said floor, and wherein each of said walls are integrally secured to one another at respective corners to form a linear seam wherein three corners have linear seams of equal length and a fourth corner comprises a linear seam of approximately one-half th length of the other seams with said pouring spout means formed aligned with said fourth seam and extending outwardly of said fourth seam, said securement means being a discontinuous split ring integrally secured to and extending upwardly of said planar floor and formed with a slit opening aligned with said pouring spout, and wherein said discontinuous split ring includes a medially positioned bulged inwardly directed clamping ring to engage and clamp said paint can to said ring, and an upper wall positioned above said ring outwardly directed from said clamping ring portion.

* * * * *